US008218778B2

(12) United States Patent
Bai

(10) Patent No.: US 8,218,778 B2
(45) **Date of Patent: *Jul. 10, 2012**

(54) METHOD FOR SHOWING ARRAY MICROPHONE EFFECT

(75) Inventor: Bo-Ren Bai, Chiayi County (TW)

(73) Assignee: Fortemedia, Inc., Sunnyvale, CA (US)

( * ) Notice: Subject to any disclaimer, the term of this patent is extended or adjusted under 35 U.S.C. 154(b) by 718 days.

This patent is subject to a terminal disclaimer.

(21) Appl. No.: 12/356,576

(22) Filed: Jan. 21, 2009

(65) Prior Publication Data

US 2010/0182319 A1 Jul. 22, 2010

(51) Int. Cl.
*H04R 29/00* (2006.01)

(52) U.S. Cl. ..... 381/56; 381/58; 381/61; 381/92

(58) Field of Classification Search ..... 381/56, 381/58, 61, 92
See application file for complete search history.

(56) References Cited

U.S. PATENT DOCUMENTS

2009/0022330 A1* 1/2009 Haulick et al. ..... 381/57
2009/0141912 A1* 6/2009 Hiekata ..... 381/122
2009/0147968 A1* 6/2009 Inoda et al. ..... 381/94.1

* cited by examiner

*Primary Examiner* — Wai Sing Louie
(74) *Attorney, Agent, or Firm* — Thomas|Kayden

(57) ABSTRACT

A method for showing an array microphone effect includes the steps of obtaining an original acoustic signal from array microphones, and visualizing the original acoustic signal to obtain a figure. The original acoustic signal includes a crystal voice, out-beam noises, background noise, and/or an echo. The figure includes a plurality of graphic components representing the crystal voice, out-beam noise, background noise, and/or echo, respectively.

22 Claims, 14 Drawing Sheets

METHOD FOR SHOWING ARRAY MICROPHONE EFFECT

BACKGROUND OF THE INVENTION

1. Field of the Invention

The invention relates to a method for showing an array microphone effect, and more particularly to a method for visualizing an original acoustic signal obtained by array microphones, enabling the user to know what sounds the array microphones are picking up at any time.

2. Description of the Related Art

A microphone array is capable of clearly receiving sound from a particular direction while avoiding noise and/or echo, and is often applied in high-quality audio recorders or communications devices.

There are different types of microphone arrays. For example, a broadband microphone array includes two omni-directional microphones that simultaneously receive sound, thereby forming a pie beam, wherein a designated signal within the beam is received, and noise outside of the beam is suppressed. For another example, a SAM (small array microphone) includes a uni-directional microphone and an omni-directional microphone that simultaneously receive sound, thereby forming a cone beam, wherein a designated signal within the beam is received. Alternatively, a SAM includes two omni-directional microphones that simultaneously receive sound, thereby forming a pie beam or a cone beam, wherein a designated signal within the beam is received.

FIG. 1A depicts an example of a pie beam 130 which is defined in front of and at the rear of a microphone array 110. As shown, a notebook computer is provided with the microphone array 110 on the top and connected to two loudspeakers 120 on both sides, thus allowing a user to communicate with other people at a far end through an internet. Original acoustic signals picked up by the array microphones 110 include a crystal voice (the user's voice within a pie beam 130), echo, background noise, and out-beam noise. The original acoustic signals are then processed by hardware (e.g. IC chip) or software, wherein the echo is canceled, the background noise and out-beam noise are suppressed, and the crystal voice is sent to the far-end talker through the internet. Also, the far-end talker's voice is output from the loudspeakers 120.

FIG. 1B depicts an example of a cone beam 130' which is defined in front of a microphone array 110'. As shown, a notebook computer is provided with the microphone array 110' on the top and connected to two loudspeakers 120' disposed on a side, thus allowing a user to communicate with other people at a far end through an internet. Similarly, original acoustic signals picked up by the array microphones 110' include a crystal voice (user's voice in a cone beam 130'), echo, background noise, and out-beam noise. The original acoustic signals are then processed by hardware or software, wherein the echo is canceled, the background noise and out-beam noise are suppressed, and the crystal voice is sent to the far-end talker through the internet Also, the far-end talker's voice is output from the loudspeakers 120'.

BRIEF SUMMARY OF THE INVENTION

The invention provides a method for showing an array microphone effect. The method in accordance with an exemplary embodiment of the invention includes the steps of obtaining an original acoustic signal from array microphones, and visualizing the original acoustic signal to obtain a figure which includes a plurality of graphic components.

In another exemplary embodiment of the invention, the plurality of graphic components respectively represents a crystal voice and noise when the original acoustic signal includes the crystal voice and noise.

In yet another exemplary embodiment of the invention, the noise includes background noise.

In another exemplary embodiment of the invention, the noise includes out-beam noise.

In yet another exemplary embodiment of the invention, the plurality of graphic components respectively represents a crystal voice and an echo when the original acoustic signal includes the crystal voice and the echo.

In another exemplary embodiment of the invention, the plurality of graphic components respectively represents an echo and noise when the original acoustic signal includes the echo and noise.

In yet another exemplary embodiment of the invention, one of the graphic components includes a plurality of parts which respectively represent different crystal voices from different sound sources.

In another exemplary embodiment of the invention, one of the graphic components represents a pie beam.

In yet another exemplary embodiment of the invention, one of the graphic components represents a cone beam.

In another exemplary embodiment of the invention, the figure is one-dimensional.

In yet another exemplary embodiment of the invention, the plurality of graphic components is connected in series.

In another exemplary embodiment of the invention, one of the graphic components overlaps other graphic components.

In yet another exemplary embodiment of the invention, lengths of the graphic components are time-variable.

In another exemplary embodiment of the invention, one of the graphic components shows a color spectrum.

In yet another exemplary embodiment of the invention, the figure is two-dimensional.

In another exemplary embodiment of the invention, the plurality of graphic components is laid to overlap with each other.

In yet another exemplary embodiment of the invention, the plurality of graphic components differs from each other in color.

In another exemplary embodiment of the invention, the plurality of graphic components differs from each other in gray level.

In yet another exemplary embodiment of the invention, the plurality of graphic components differs from each other in shape.

In another exemplary embodiment of the invention, the plurality of graphic components differs from each other in size.

In yet another exemplary embodiment of the invention, the method for showing an array microphone effect further includes generating a symbol in the figure when surroundings of the array microphones are silent.

In another exemplary embodiment of the invention, the figure is a run chart showing variations of the original acoustic signal with respect to time.

In yet another exemplary embodiment of the invention, the method includes the steps of obtaining an original acoustic signal from array microphones, and visualizing the original acoustic signal to obtain a figure which includes a graphic component.

In another exemplary embodiment of the invention, the graphic component represents a crystal voice when the original acoustic signal includes the crystal voice.

In yet another exemplary embodiment of the invention, the method for showing an array microphone effect further includes generating a symbol in the figure when a volume of the crystal voice is saturated.

In another exemplary embodiment of the invention, the graphic component represents background noise when the original acoustic signal includes the background noise.

In yet another exemplary embodiment of the invention, the graphic component represents out-beam noise when the original acoustic signal includes the out-beam noise.

In another exemplary embodiment of the invention, the graphic component represents an echo when the original acoustic signal includes an echo.

In yet another exemplary embodiment of the invention, the graphic component represents a pie beam.

In another exemplary embodiment of the invention, one of the graphic components represents a cone beam.

In yet another exemplary embodiment of the invention, the method for showing an array microphone effect further includes generating a symbol in the figure when surroundings of the array microphones are silent.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

The invention provides a method for showing an array microphone effect, including the steps of obtaining an original acoustic signal from array microphones, and visualizing the original acoustic signal to obtain a figure. The figure may be one-dimensional (as shown in FIGS. 2A-2F, 4A-4E, 6A-6E, 8, and 9A-9C) or two-dimensional (as shown in FIGS. 3A-3E, 5A-5D, 7A-7D, 10, and 11) or even three-dimensional, and shown in a monitor, thus enabling the user to know what sounds the array microphones are picking up during operation.

Figure 1A:
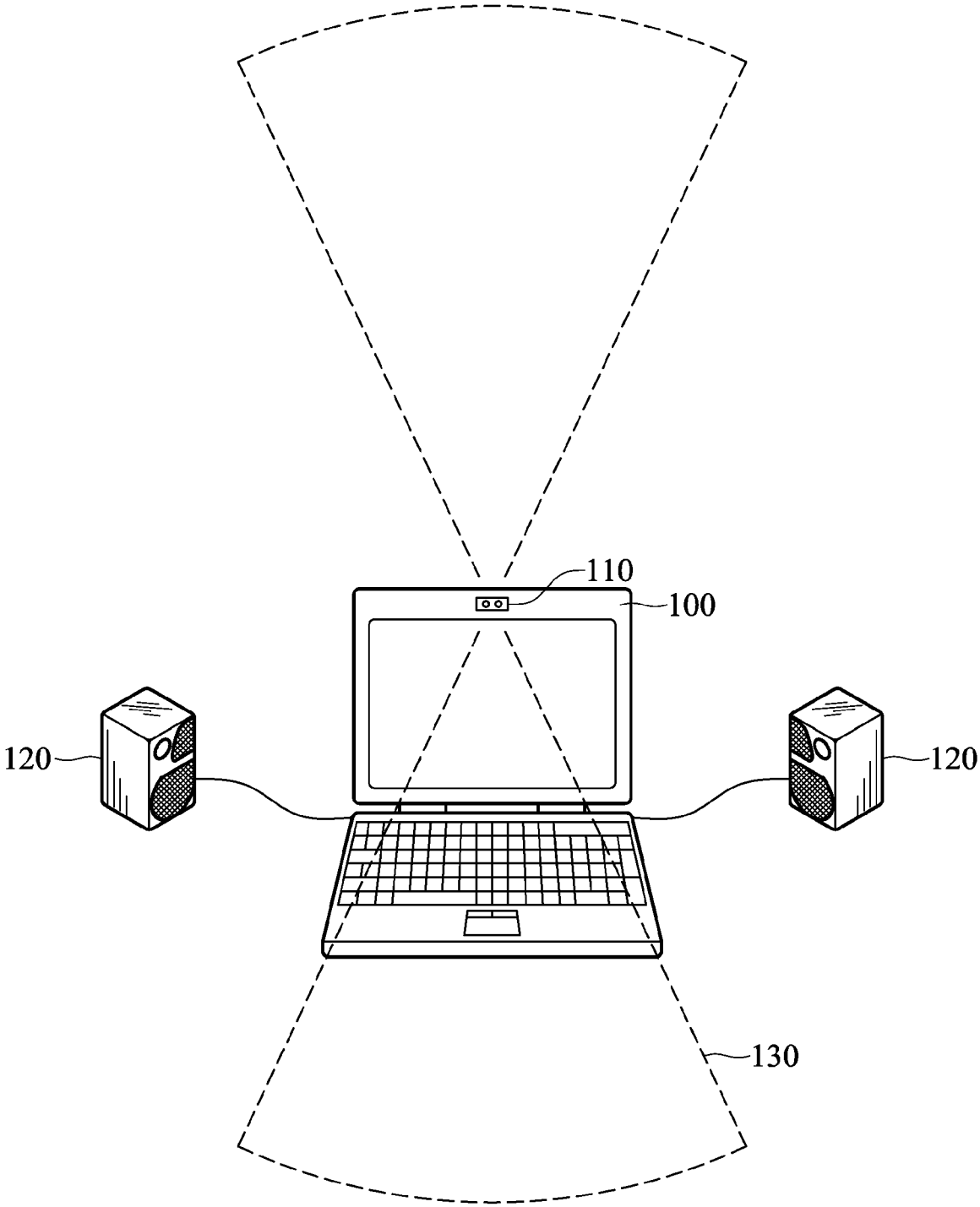
FIG. 1A (PRIOR ART)
FIG. 1A is a schematic diagram of a notebook computer with a microphone array, wherein a pie beam is defined in front of and at the rear of the microphone array.
Figure 1B:
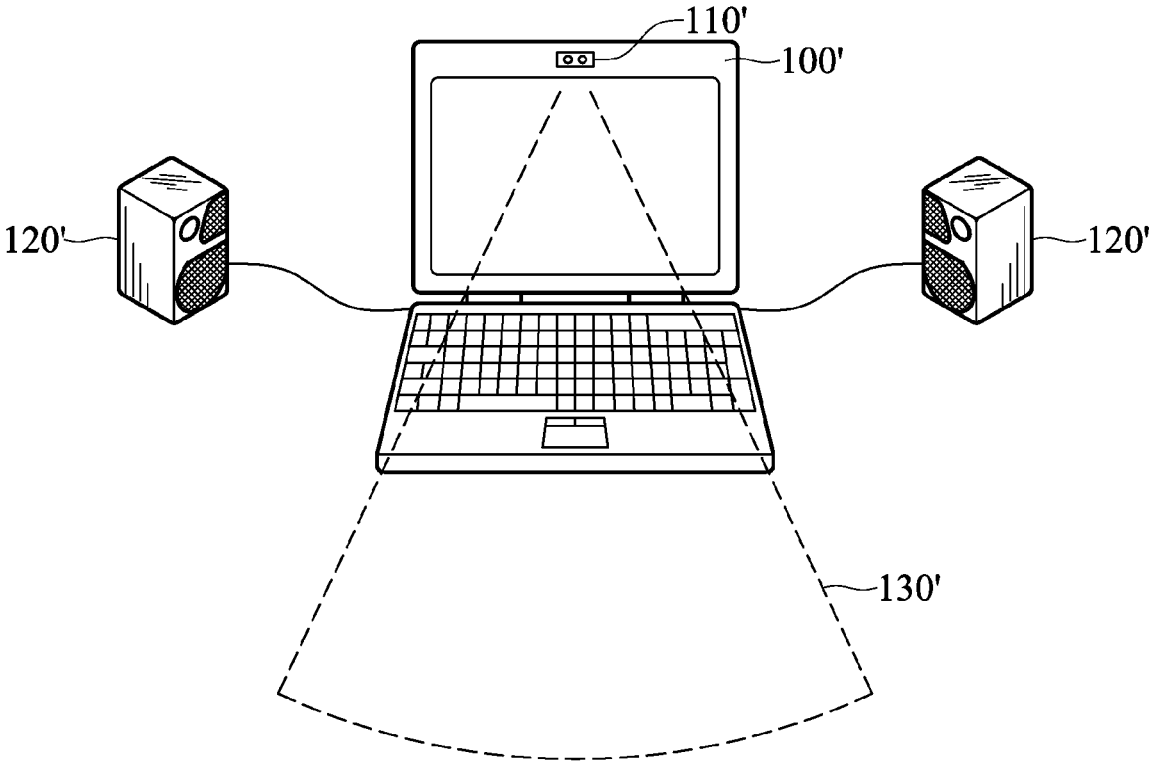
FIG. 1B (PRIOR ART)
FIG. 1B is a schematic diagram of a notebook computer with a microphone array, wherein a cone beam is defined in front of the microphone array.
Figure 2A:
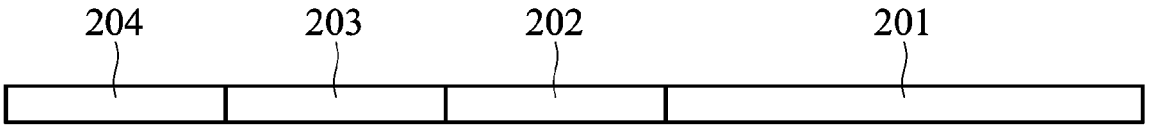
FIG. 2A is the figure obtained by visualizing the original acoustic signal in accordance with a first embodiment of the invention, wherein the original acoustic signal includes a crystal voice, out-beam noise, background noise, and an echo.

FIG. 2A is the figure obtained by visualizing the original acoustic signal in accordance with a first embodiment of the invention, wherein echo cancellation and beam forming are executed during operation of the array microphones. The figure includes a plurality of graphic components 201, 202, 203, and 204, connected in series as a volume bar, respectively representing a crystal voice, out-beam noise, background noise, and an echo. The lengths of the graphic components 201, 202, 203, and 204 are time-variable, respectively depending on the volumes (or signal levels) of the crystal voice, out-beam noise, background noise, and echo. Furthermore, the graphic components 201, 202, 203, and 204 may be colored for easy distinction. It is recommended that the graphic component 201 shows a warm color and the other graphic components 202, 203, and 204 show cold colors. For example, the crystal voice 201 is orange, the out-beam noise 202 is dark blue, the background noise 203 is blue, and the echo 204 is light blue.

Alternatively, the graphic components 201, 202, 203, and 204 may differ from each other in gray level.

Figure 2B:
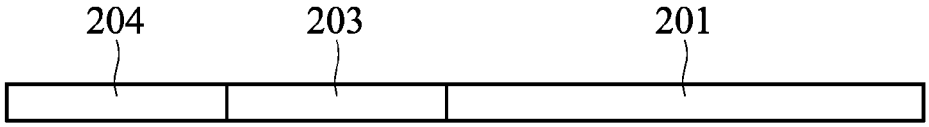
FIG. 2B shows a variation of the figure of the first embodiment of the invention, wherein the original acoustic signal includes a crystal voice, background noise, and an echo.

The volume bar is time-variable. When the original acoustic signal contains no out-beam noise, the volume bar shows no graphic component 202. As shown in FIG. 2B, the volume bar in this case includes the crystal voice 201, background noise 203, and echo 204, which are connected in series. The user is capable of understanding what sounds the array microphones are picking up by observing the volume bar (FIG. 2B) on the monitor.

Figure 2C:
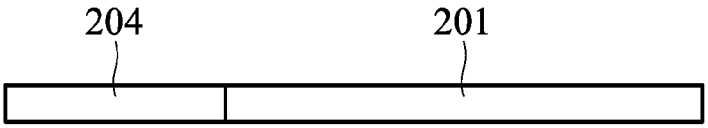
FIG. 2C shows a variation of the figure of the first embodiment of the invention, wherein the original acoustic signal includes a crystal voice and an echo.

When the original acoustic signal contains no out-beam noise and background noise, the volume bar shows no graphic components 202 and 203. As shown in FIG. 2C, the volume bar in this case includes the crystal voice 201 and echo 204, which are connected in series.

Figure 2D:
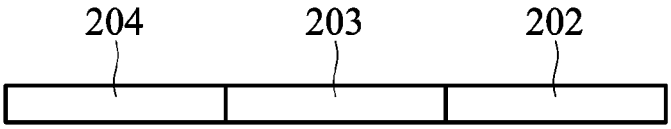
FIG. 2D shows a variation of the figure of the first embodiment of the invention, wherein the original acoustic signal includes a crystal voice.

When the original acoustic signal contains no noise and echo, the volume bar shows no graphic components 202, 203, and 204. As shown in FIG. 2D, the volume bar in this case only has the crystal voice 201.

Figure 2E:
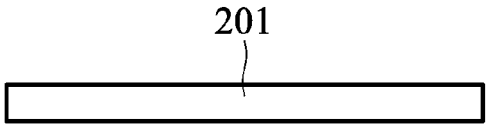
FIG. 2E shows a variation of the figure of the first embodiment of the invention, wherein the original acoustic signal includes out-beam noise, background noise, and an echo.

When the original acoustic signal contains no crystal voice, the volume bar shows no graphic component 201. As shown in FIG. 2E, the volume bar in this case includes the out-beam noise 202, background noise 203, and echo 204, which are connected in series.

Figure 2F:
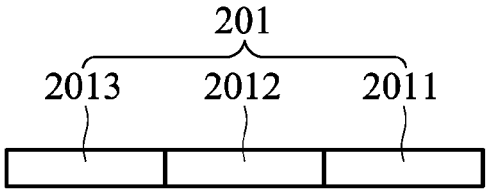
FIG. 2F shows a modified example of a graphic component of FIG. 2A, wherein the graphic component representing the crystal voice includes a plurality of parts which represent different talkers' voices.

The graphic component 201 representing the crystal voice can be modified in various ways. For example, the graphic component 201 may show the volume (or signal level) of the crystal voice with a color spectrum. When the volume (or signal level) of the crystal voice is small, the graphic component 201 is yellow and short. When the volume (or signal level) of the crystal voice is medium, the graphic component 201 includes yellow and orange and becomes longer. When the volume (or signal level) of the crystal voice is large, the graphic component 201 includes yellow, orange, and red, and becomes much longer. Referring to FIG. 2F, for another example, the graphic component 201 may include a plurality of parts 2011, 2012, and 2013 which respectively represent different talkers' voices.

It is therefore understood that the variations of the volume bar enable the user to know what sounds the array microphones are picking up at any time.

Figure 3A:
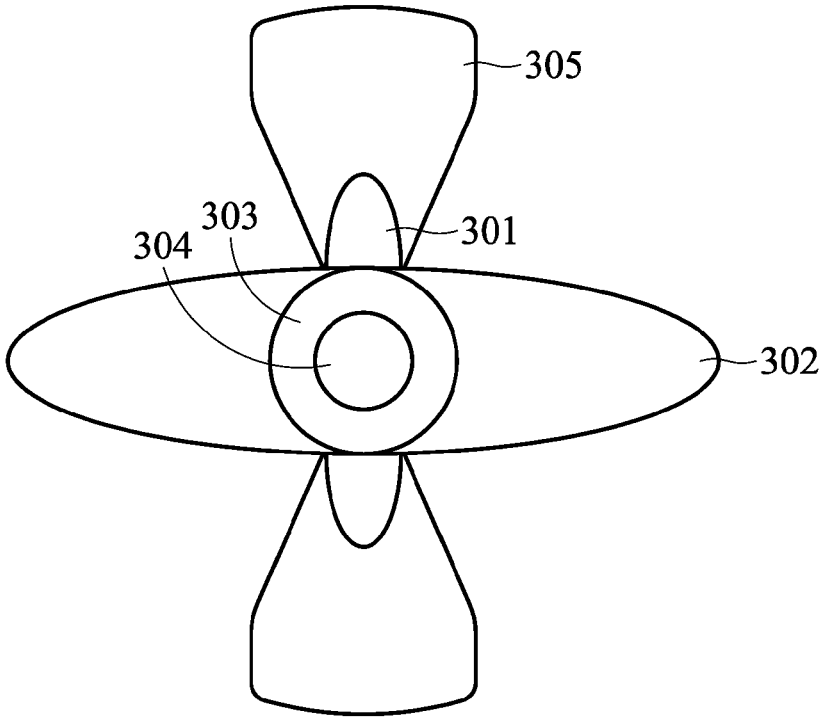
FIG. 3A is the figure obtained by visualizing the original acoustic signal in accordance with a second embodiment of the invention, wherein the original acoustic signal includes a crystal voice, out-beam noise, background noise, and an echo.

FIG. 3A is the figure obtained by visualizing the original acoustic signal in accordance with a second embodiment of the invention, wherein echo cancellation and beam forming are executed during operation of the array microphones. The figure includes a plurality of graphic components 301, 302, 303, 304, and 305 respectively representing a crystal voice, out-beam noise, background noise, an echo, and a pie beam. The figure is two dimensional wherein the graphic components 301, 302, 303, 304, and 305 with different shapes and sizes are laid out to overlap with each other. The graphic components 301, 302, 303, and 304 may be colored for further distinction. Similar to the first embodiment, it is recommended that the graphic component 301 shows a warm color and the other graphic components 302, 303, and 304 show cold colors. For example, the crystal voice 301 is orange, the out-beam noise 302 is dark blue, the background noise 303 is blue, and the echo 304 is light blue. The color of the graphic component 305 is not limited. In this embodiment, the pie beam 305 is green.

Alternatively, the graphic components 301, 302, 303, 304, and 305 may differ from each other in gray level.

Figure 3B:
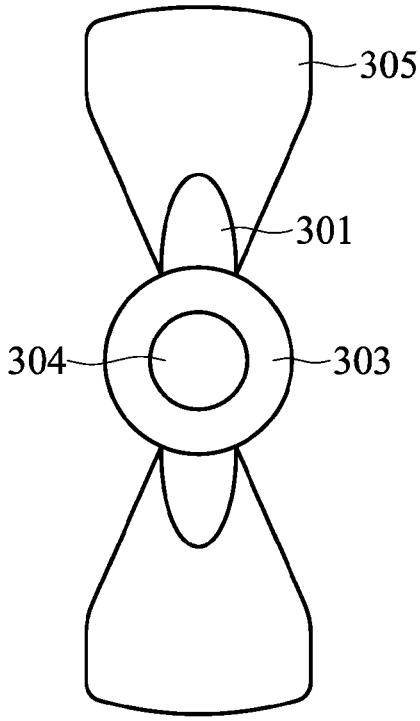
FIG. 3B shows a variation of the figure of the second embodiment of the invention, wherein the original acoustic signal includes a crystal voice, background noise, and an echo.

When the original acoustic signal contains no out-beam noise, the figure shows no graphic component 302. As shown in FIG. 3B, the figure in this case includes the crystal voice 301, background noise 303, echo 304, and pie beam 305, which overlap with each other. The user is capable of understanding what sounds the array microphones are picking up by observing the figure (FIG. 3B) on the monitor.

Figure 3C:
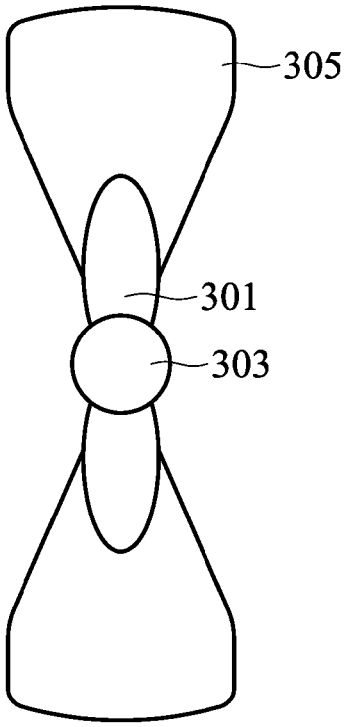
FIG. 3C shows a variation of the figure of the second embodiment of the invention, wherein the original acoustic signal includes a crystal voice and an echo.

When the original acoustic signal contains no out-beam noise and background noise, the figure shows no graphic components 302 and 303. As shown in FIG. 3C, the figure in this case includes the crystal voice 301, echo 304, and pie beam 305, which overlap with each other.

Figure 3D:
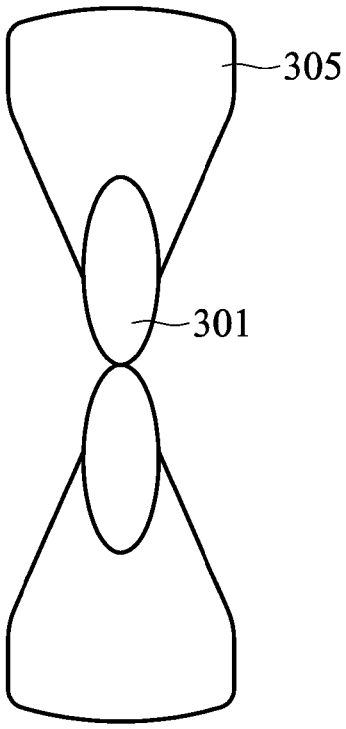
FIG. 3D shows a variation of the figure of the second embodiment of the invention, wherein the original acoustic signal includes a crystal voice.

When the original acoustic signal contains no noise and echo, the figure shows no graphic components 302, 303, and 304. As shown in FIG. 3D, the figure in this case only has the crystal voice 301 and pie beam 305.

Figure 3E:
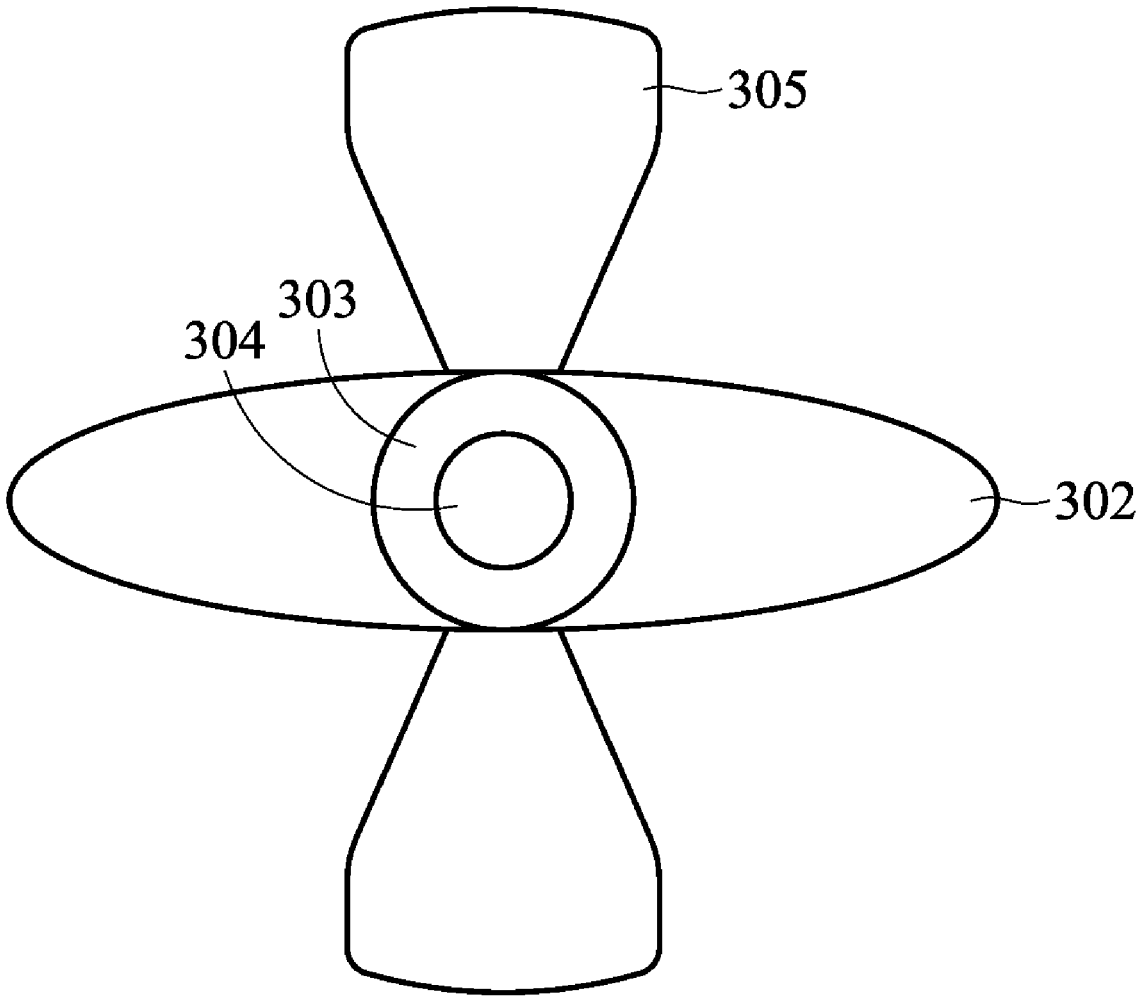
FIG. 3E shows a variation of the figure of the second embodiment of the invention, wherein the original acoustic signal includes out-beam noise, background noise, and an echo.

When the original acoustic signal contains no crystal voice, the figure shows no graphic component 301. As shown in FIG. 3E, the figure in this case includes the out-beam noise 302, background noise 303, echo 304, and pie beam 305, which overlap with each other.

It is therefore understood that the variations of the figure of the second embodiment enable the user to know what sounds the array microphones are picking up at any time.

Figure 4A:
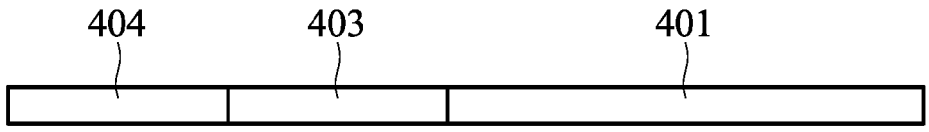
FIG. 4A is the figure obtained by visualizing the original acoustic signal in accordance with a third embodiment of the invention, wherein the original acoustic signal includes a crystal voice, background noise, and an echo.

FIG. 4A is the figure obtained by visualizing the original acoustic signal in accordance with a third embodiment of the invention, wherein echo cancellation is executed during operation of the array microphones. The figure includes a plurality of graphic components 401, 403, and 404, connected in series as a volume bar, respectively representing a crystal voice, background noise, and an echo. The lengths of the graphic components 401, 403, and 404 are time-variable, depending on the volumes (or signal levels) of the crystal voice, background noise, and echo. Furthermore, the graphic components 401, 403, and 404 are colored for easy distinction. The graphic component 401 may show a warm color and the other graphic components 403 and 404 show cold colors. For example, the crystal voice 401 is orange, the background noise 403 is blue, and the echo 404 is light blue.

Alternatively, the graphic components 401, 403, and 404 may differ from each other in gray level.

Figure 4B:
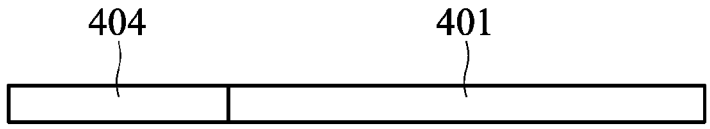
FIG. 4B shows a variation of the figure of the third embodiment of the invention, wherein the original acoustic signal includes a crystal voice and an echo.

The volume bar is time-variable. When the original acoustic signal contains no background noise, the volume bar shows no graphic component 403. As shown in FIG. 4B, the volume bar in this case includes the crystal voice 401 and echo 404, which are connected in series. The user is capable of understanding what sounds the array microphones are picking up by observing the volume bar (FIG. 4B) on the monitor.

Figure 4C:
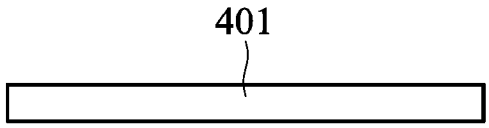
FIG. 4C shows a variation of the figure of the third embodiment of the invention, wherein the original acoustic signal includes a crystal voice.

When the original acoustic signal contains no noise and echo, the volume bar shows no graphic components 403 and 404. As shown in FIG. 4C, the volume bar in this case only has the crystal voice 401.

Figure 4D:
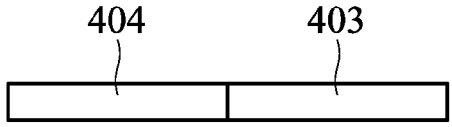
FIG. 4D shows a variation of the figure of the third embodiment of the invention, wherein the original acoustic signal includes background noise, and an echo.

When the original acoustic signal contains no crystal voice, the volume bar shows no graphic component 401. As shown in FIG. 4D, the volume bar in this case includes the background noise 403 and echo 404, which are connected in series.

Figure 4E:
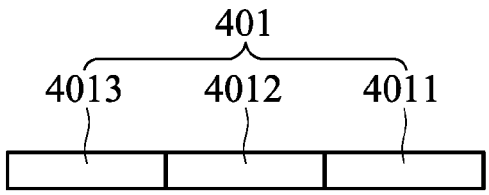
FIG. 4E shows a modified example of a graphic component of FIG. 4A, wherein the graphic component representing the crystal voice includes a plurality of parts which represent different talkers' voices.

The graphic component 401 representing the crystal voice can be modified in various ways. For example, the graphic component 401 may show the volume (or signal level) of the crystal voice with a color spectrum. When the volume (or signal level) of the crystal voice is small, the graphic component 401 is yellow and short. When the volume (or signal level) of the crystal voice is medium, the graphic component 401 includes yellow and orange and becomes longer. When the volume (or signal level) of the crystal voice is large, the graphic component 401 includes yellow, orange, and red, and becomes much longer. Referring to FIG. 4E, for another example, the graphic component 401 may include a plurality of parts 4011, 4012, and 4013 which respectively represent different talkers' voices.

It is therefore understood that the variations of the volume bar of the third embodiment enable the user to know what sounds the array microphones are picking up at any time.

Figure 5A:
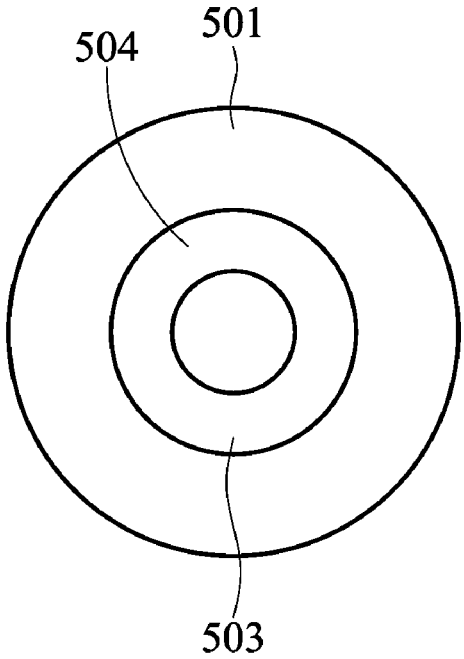
FIG. 5A is the figure obtained by visualizing the original acoustic signal in accordance with a fourth embodiment of the invention, wherein the original acoustic signal includes a crystal voice, background noise, and an echo.

FIG. 5A is the figure obtained by visualizing the original acoustic signal in accordance with a fourth embodiment of the invention, wherein echo cancellation is executed during operation of the array microphones. The figure includes a plurality of graphic components 501, 503, and 504 respectively representing a crystal voice, background noise, and an echo. The figure is two dimensional wherein the graphic components 501, 503, and 504 with different sizes are laid out to overlap with each other. The graphic components 501, 503, and 504 are colored for further distinction. Similar to the above embodiments, it is recommended that the graphic component 501 shows a warm color and the other graphic components 503 and 504 show cold colors. For example, the crystal voice 501 is orange, the background noise 503 is blue, and the echo 504 is light blue.

Alternatively, the graphic components 501, 503, and 504 may differ from each other in gray level.

Figure 5B:
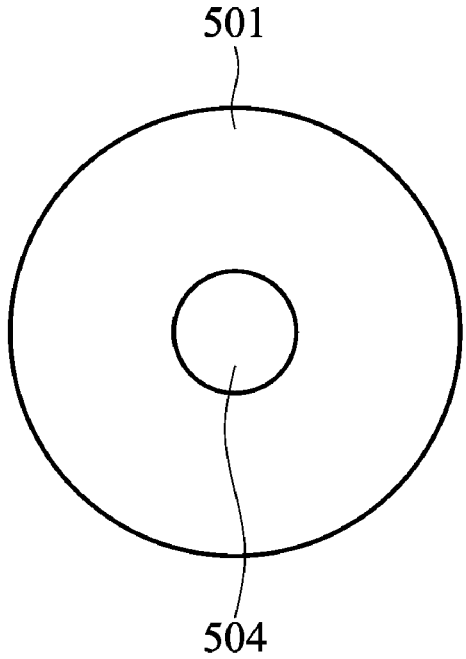
FIG. 5B shows a variation of the figure of the fourth embodiment of the invention, wherein the original acoustic signal includes a crystal voice and an echo.

When the original acoustic signal contains no background noise, the figure shows no graphic component 503. As shown in FIG. 5B, the figure in this case includes the crystal voice 501 and echo 504, which overlap with each other. The user is capable of understanding what sounds the array microphones are picking up by observing the figure (FIG. 5B) on the monitor.

Figure 5C:
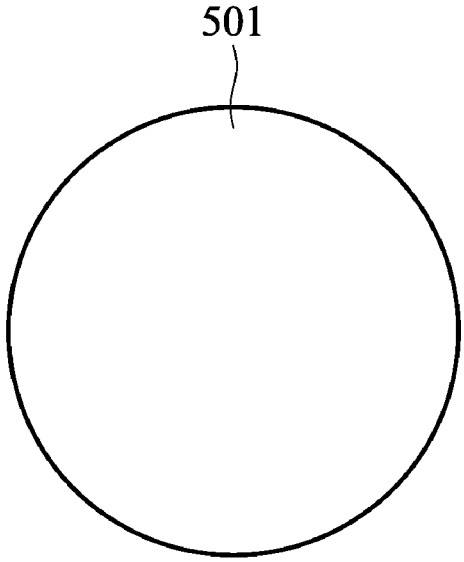
FIG. 5C shows a variation of the figure of the fourth embodiment of the invention, wherein the original acoustic signal includes a crystal voice.

When the original acoustic signal contains no background noise and echo, the figure shows no graphic components 503 and 504. As shown in FIG. 5C, the figure in this case only has the crystal voice 501.

Figure 5D:
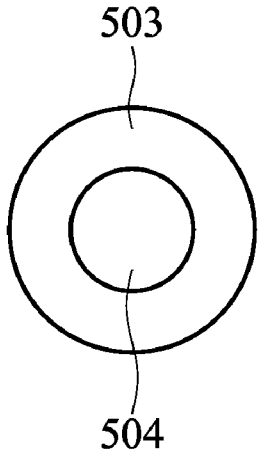
FIG. 5D shows a variation of the figure of the fourth embodiment of the invention, wherein the original acoustic signal includes background noise, and an echo.

When the original acoustic signal contains no crystal voice, the figure shows no graphic component 501. As shown in FIG. 5D, the figure in this case includes the background noise 503 and echo 504, which overlap with each other.

It is therefore understood that the variations of the figure of the fourth embodiment enable the user to know what sounds the array microphones are picking up at any time.

Figure 6A:
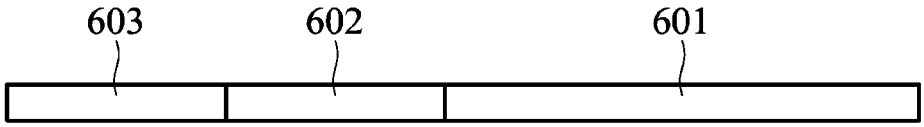
FIG. 6A is the figure obtained by visualizing the original acoustic signal in accordance with a fifth embodiment of the invention, wherein the original acoustic signal includes a crystal voice, out-beam noise, and background noise.

FIG. 6A is the figure obtained by visualizing the original acoustic signal in accordance with a fifth embodiment of the invention, wherein beam forming is executed during operation of the array microphones. The figure includes a plurality of graphic components 601, 602, and 603, connected in series as a volume bar, respectively representing a crystal voice, out-beam noise, and background noise. The lengths of the graphic components 601, 602, and 603 are time-variable, depending on the volumes (or signal levels) of the crystal voice, out-beam noise, and background noise. Furthermore, the graphic components 601, 602, and 603 are colored for easy distinction. The graphic component 601 may show a warm color and the other graphic components 602 and 603 show cold colors. For example, the crystal voice 601 is orange, the out-beam noise 602 is dark blue, and the background noise 603 is blue.

Alternatively, the graphic components 601, 602, and 603 may differ from each other in gray level.

Figure 6B:
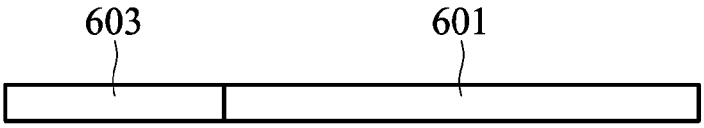
FIG. 6B shows a variation of the figure of the fifth embodiment of the invention, wherein the original acoustic signal includes a crystal voice and background noise.

The volume bar is time-variable. When the original acoustic signal contains no out-beam noise, the volume bar shows no graphic component 602. As shown in FIG. 6B, the volume bar in this case includes the crystal voice 601 and background noise 603, which are connected in series. The user is capable of understanding what sounds the array microphones are picking up by observing the volume bar (FIG. 6B) on the monitor.

Figure 6C:
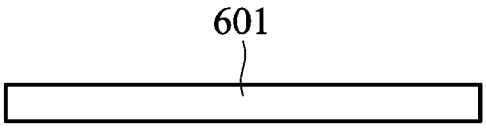
FIG. 6C shows a variation of the figure of the fifth embodiment of the invention, wherein the original acoustic signal includes a crystal voice.

When the original acoustic signal contains no out-beam noise and background noise, the volume bar shows no graphic components 602 and 603. As shown in FIG. 6C, the volume bar in this case only has the crystal voice 601.

Figure 6D:
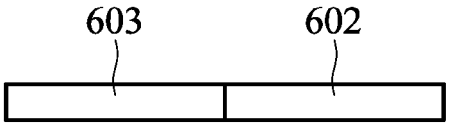
FIG. 6D shows a variation of the figure of the fifth embodiment of the invention, wherein the original acoustic signal includes out-beam noise and background noise.

When the original acoustic signal contains no crystal voice, the volume bar shows no graphic component 601. As shown in FIG. 6D, the volume bar in this case includes the out-beam noise 602 and background noise 603, which are connected in series.

Figure 6E:
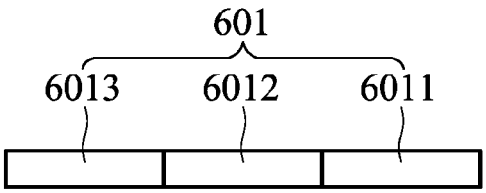
FIG. 6E shows a modified example of a graphic component of FIG. 6A, wherein the graphic component representing the crystal voice includes a plurality of parts which represent different talkers' voices.

The graphic component 601 representing the crystal voice can be modified in various ways. For example, the graphic component 601 may show the volume (or signal level) of the crystal voice with a color spectrum. When the volume (or signal level) of the crystal voice is small, the graphic component 601 is yellow and short. When the volume (or signal level) of the crystal voice is medium, the graphic component 601 includes yellow and orange and becomes longer. When the volume (or signal level) of the crystal voice is large, the graphic component 601 includes yellow, orange, and red, and becomes much longer. Referring to FIG. 6E, for another example, the graphic component 601 may include a plurality of parts 6011, 6012, and 6013 which respectively represent different talkers'voices.

It is therefore understood that the variations of the volume bar of the fifth embodiment enable the user to know what sounds the array microphones are picking up at any time.

Figure 7A:
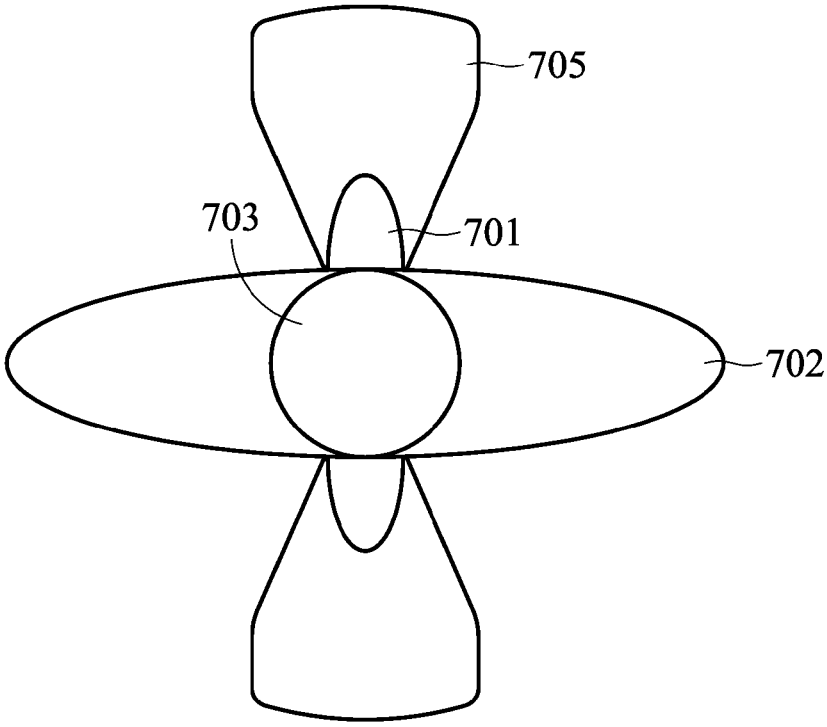
FIG. 7A is the figure obtained by visualizing the original acoustic signal in accordance with a sixth embodiment of the invention, wherein the original acoustic signal includes a crystal voice, out-beam noise, and background noise.

FIG. 7A is the figure obtained by visualizing the original acoustic signal in accordance with a sixth embodiment of the invention, wherein beam forming is executed during operation of the array microphones. The figure includes a plurality of graphic components 701, 702, 703, and 705 respectively representing a crystal voice, out-beam noise, background noise, and a pie beam. The figure is two dimensional wherein the graphic components 701, 702, 703, and 705 with different shapes and sizes are laid out to overlap with each other. The graphic components 701, 702, 703, and 705 may be colored for further distinction. Similar to the above embodiments, it is recommended that the graphic component 701 shows a warm color and the other graphic components 702 and 703 show cold colors. For example, the crystal voice 701 is orange, the out-beam noise 702 is dark blue, and the background noise 703 is blue. The color of the graphic component 705 is not limited. In this embodiment, the pie beam 705 is green.

Alternatively, the graphic components 701, 702, 703, and 705 may differ from each other in gray level.

Figure 7B:
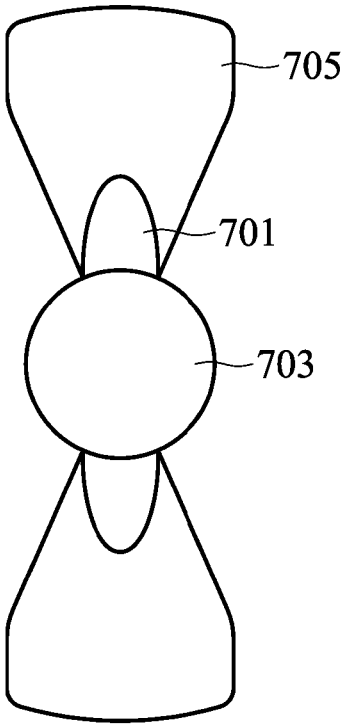
FIG. 7B shows a variation of the figure of the sixth embodiment of the invention, wherein the original acoustic signal includes a crystal voice and background noise.

When the original acoustic signal contains no out-beam noise, the figure shows no graphic component 702. As shown in FIG. 7B, the figure in this case includes the crystal voice 701, background noise 703, and pie beam 705, which overlap with each other. The user is capable of understanding what sounds the array microphones are picking up by observing the figure (FIG. 7B) on the monitor.

Figure 7C:
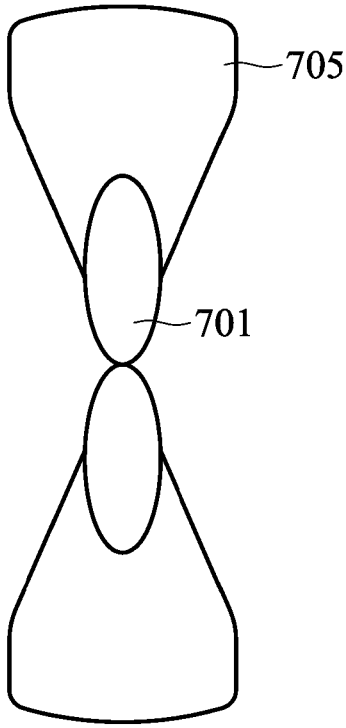
FIG. 7C shows a variation of the figure of the sixth embodiment of the invention, wherein the original acoustic signal includes a crystal voice.

When the original acoustic signal contains no out-beam noise and background noise, the figure shows no graphic components 702 and 703. As shown in FIG. 7C, the figure in this case includes the crystal voice 701 and pie beam 705, which overlap with each other.

Figure 7D:
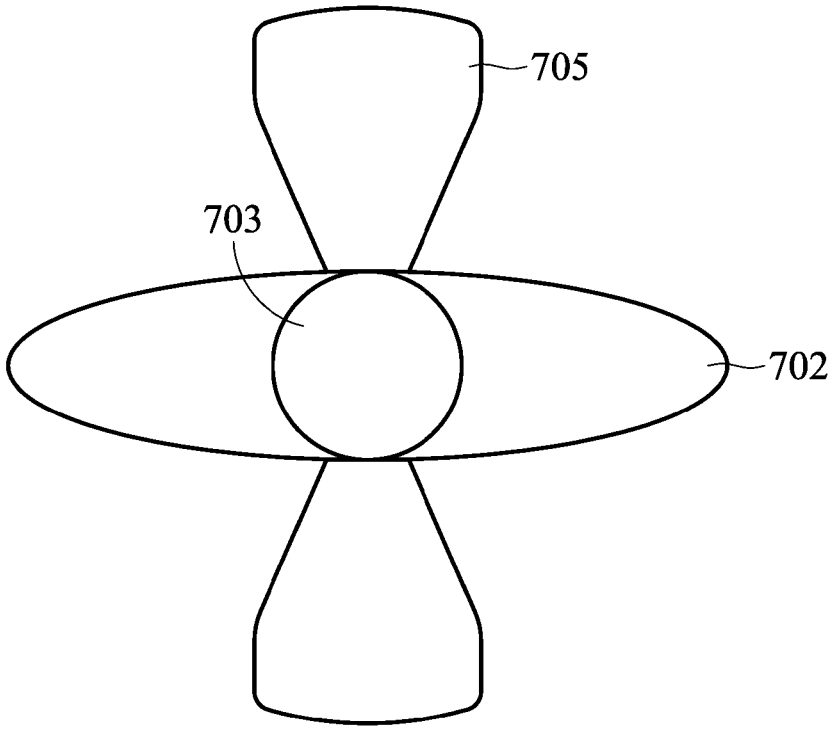
FIG. 7D shows a variation of the figure of the sixth embodiment of the invention, wherein the original acoustic signal includes out-beam noise and background noise.

When the original acoustic signal contains no crystal voice, the figure shows no graphic component 701. As shown in FIG. 7D, the figure in this case includes the out-beam noise 702, background noise 703, and pie beam 705, which overlap with each other.

It is therefore understood that the variations of the figure of the sixth embodiment enable the user to know what sounds the array microphones are picking up at any time.

Figure 8:
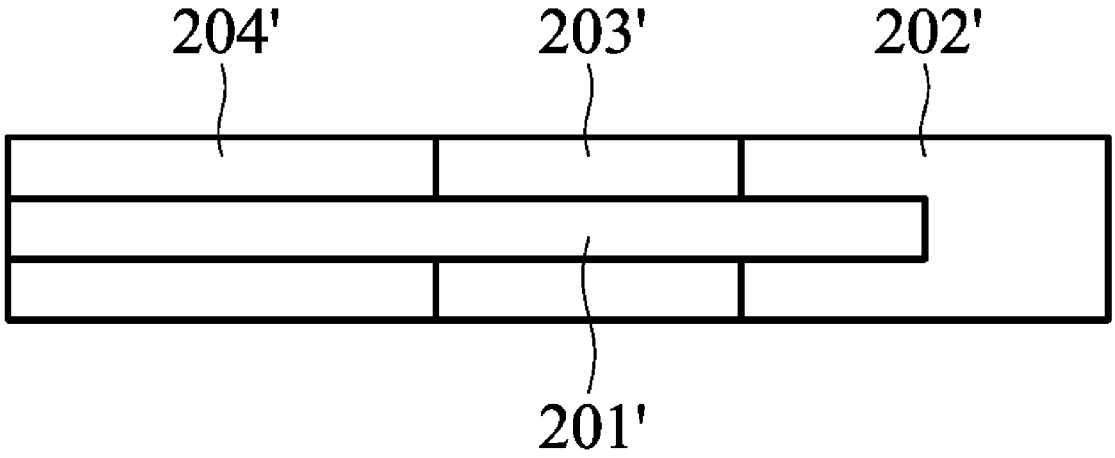
FIG. 8 is the figure obtained by visualizing the original acoustic signal in accordance with a seventh embodiment of the invention, wherein the original acoustic signal includes a crystal voice, out-beam noise, background noise, and an echo.

FIG. 8 is the figure obtained by visualizing the original acoustic signal in accordance with a seventh embodiment of the invention, wherein echo cancellation and beam forming are executed during operation of the array microphones. The figure includes a plurality of graphic components 202', 203', and 204', connected in series as a volume bar, respectively representing out-beam noise, background noise, and an echo. The graphic component 201', overlapping the other graphic components 202', 203', and 204', represents a crystal voice. The lengths of the graphic components 201', 202', 203', and 204' are time-variable, depending on the volumes of the crystal voice, out-beam noise, background noise, and echo. Furthermore, the graphic components 201', 202', 203', and 204' are colored for easy distinction. The graphic component 201' may show a warm color and the other graphic components 202', 203', and 204' show cold colors. For example, the crystal voice 201' is orange, the out-beam noise 202' is dark blue, the background noise 203' is blue, and the echo 204' is light blue.

Alternatively, the graphic components 201', 202', 203', and 204' may differ from each other in gray level.

From the above descriptions, it is understood that the figure of the seventh embodiment is time-variable, enabling the user to know what sounds the array microphones are picking up at any time.

Figure 9A:
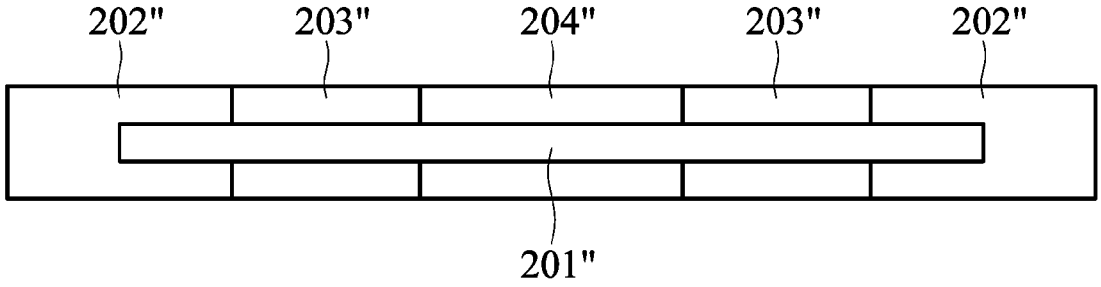
FIG. 9A is the figure obtained by visualizing the original acoustic signal in accordance with an eighth embodiment of the invention, wherein the original acoustic signal includes a crystal voice, out-beam noise, background noise, and an echo.

FIG. 9A is the figure obtained by visualizing the original acoustic signal in accordance with an eighth embodiment of the invention, wherein echo cancellation and beam forming are executed during operation of the array microphones. The figure includes a plurality of graphic components 201", 202", 203", and 204" respectively representing a crystal voice, out-beam noise, background noise, and an echo. Both sides of the figure are symmetrical, with the graphic component 204" located at the middle, two graphic components 203" located on both sides of the graphic component 204", two components 202" located on both sides of the graphic components 203", and the graphic component 201", overlapping the other graphic components 202", 203", and 204".

The lengths of the graphic components 201", 202", 203", and 204" are time-variable, depending on the volumes of the crystal voice, out-beam noise, background noise, and echo. Furthermore, the graphic components 201", 202", 203", and 204" may be colored for easy distinction. The graphic component 201" may show a warm color and the other graphic components 202", 203", and 204" show cold colors. For example, the crystal voice 201" is orange, the out-beam noise 202" is dark blue, the background noise 203" is blue, and the echo 204" is light blue.

Alternatively, the graphic components 201', 202', 203', and 204' may differ from each other in gray level.

Figure 9B:
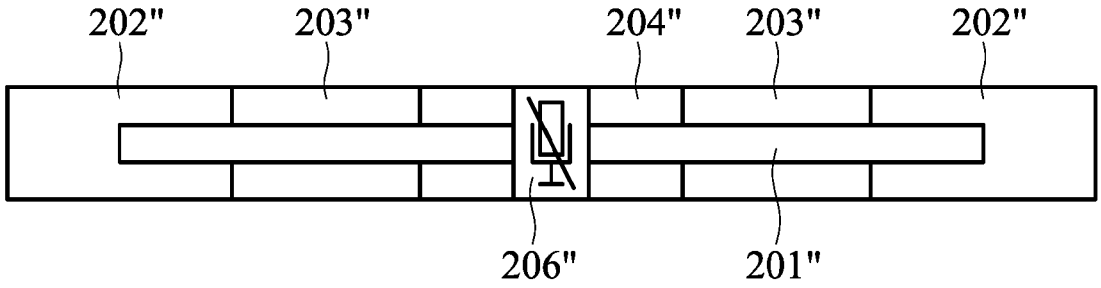
FIG. 9B shows a variation of the figure of the eighth embodiment of the invention, wherein a mute symbol is shown at the middle of the figure.

Referring to FIG. 9B, a mute symbol 206" is shown at the middle of the figure when the surroundings of the array microphones are silent.

Figure 9C:
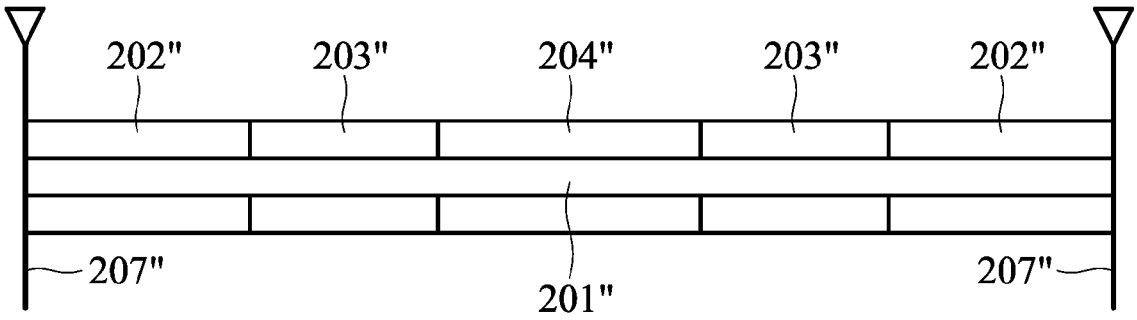
FIG. 9C shows another variation of the figure of the eighth embodiment of the invention, wherein two boundary symbols are shown at both ends of the figure.

Referring to FIG. 9C, two boundary symbols 206" are shown at the ends of the figure when the volume of the crystal voice is saturated.

From the above descriptions, it is understood that the figure of the eighth embodiment is time-variable, enabling the user to know what sounds the array microphones are picking up at any time.

Figure 10:
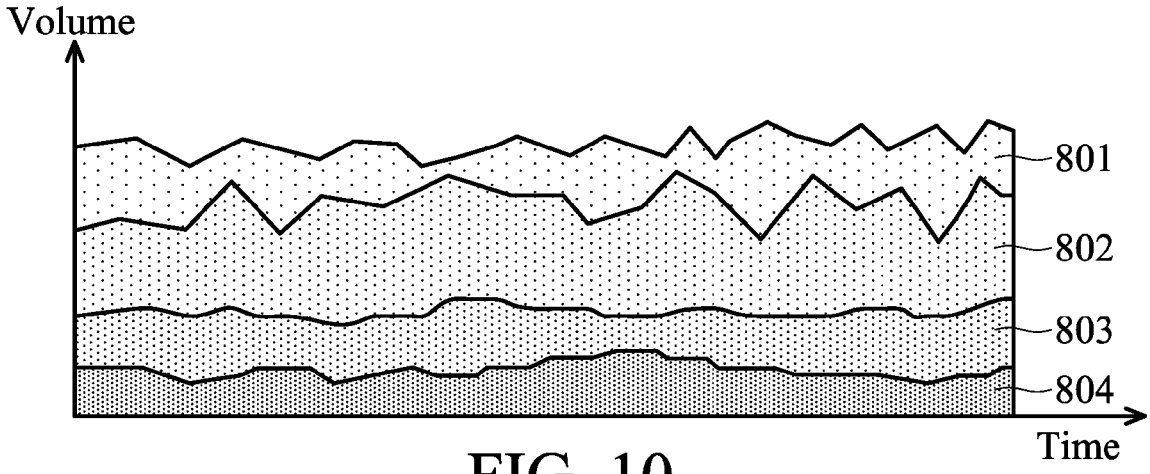
FIG. 10 is a run chart showing variations of the original acoustic signal with respect to time in accordance with a ninth embodiment of the invention.

Referring to FIG. 10, in a ninth embodiment of the invention, the figure is a run chart showing variations of the original acoustic signal with respect to time. The original acoustic signal includes a crystal voice 801, out-beam noise 802, background noise 803, and an echo 804, disposed from the top to the bottom in the run chart.

Figure 11:
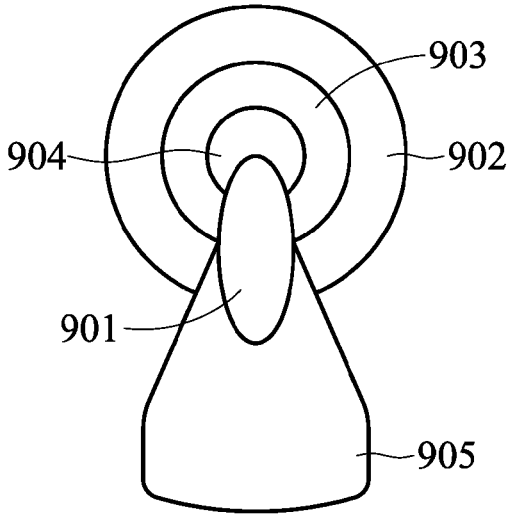
FIG. 11 is the figure obtained by visualizing the original acoustic signal in accordance with a tenth embodiment of the invention, wherein the original acoustic signal includes a crystal voice, out-beam noise, background noise, and an echo.

FIG. 11 is the figure obtained by visualizing the original acoustic signal in accordance with a tenth embodiment of the invention, wherein echo cancellation and beam forming are executed during operation of the array microphones. The figure includes a plurality of graphic components 901, 902, 903, 904, and 905 respectively representing a crystal voice, out-beam noise, background noise, an echo, and a cone beam. The figure is two dimensional wherein the graphic components 901, 902, 903, 904, and 905 with different shapes and sizes are laid out to overlap with each other. The graphic components 901, 902, 903, and 904 are colored for further distinction. The graphic component 901 may show a warm color and the other graphic components 902, 903, and 904 may show cold colors. For example, the crystal voice 901 is orange, the out-beam noise 902 is dark blue, the background noise 903 is blue, and the echo 904 is light blue. However, the color of the graphic component 905 is not limited. In this embodiment, the graphic component 905 representing a cone beam is green.

Alternatively, the graphic components 901, 902, 903, 904, and 905 may differ from each other in gray level.

Similar to the above embodiments, the figure of the tenth embodiment is time-variable, enabling the user to know what sounds the array microphones are picking up at any time.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A method for showing an array microphone effect, comprising:

obtaining an original acoustic signal from array microphones; and visualizing the original acoustic signal to obtain a figure which includes a plurality of graphic components, wherein one of the graphic components includes a plurality of parts which respectively represent different crystal voices from different sound sources.

2. The method for showing an array microphone effect as claimed in claim 1, wherein the plurality of graphic components respectively represents a crystal voice and noise when the original acoustic signal includes the crystal voice and noise.

3. The method for showing an array microphone effect as claimed in claim 2, wherein the noise includes background noise.

4. The method for showing an array microphone effect as claimed in claim 2, wherein the noise includes out-beam noise.

5. The method for showing an array microphone effect as claimed in claim 1, wherein the plurality of graphic components respectively represents a crystal voice and an echo when the original acoustic signal includes the crystal voice and the echo.

6. The method for showing an array microphone effect as claimed in claim 1, wherein the plurality of graphic components respectively represents an echo and noise when the original acoustic signal includes the echo and noise.

7. The method for showing an array microphone effect as claimed in claim 1, wherein one of the graphic components represents a pie beam.

8. The method for showing an array microphone effect as claimed in claim 1, wherein one of the graphic components represents a cone beam.

9. The method for showing an array microphone effect as claimed in claim 1, wherein the figure is one-dimensional.

10. The method for showing an array microphone effect as claimed in claim 9, wherein the plurality of graphic components is connected in series.

11. The method for showing an array microphone effect as claimed in claim 9, wherein one of the graphic components overlaps other graphic components.

12. The method for showing an array microphone effect as claimed in claim 9, wherein lengths of the graphic components are time-variable.

13. The method for showing an array microphone effect as claimed in claim 9, wherein one of the graphic components shows a color spectrum.

14. The method for showing an array microphone effect as claimed in claim 1, wherein the figure is two-dimensional.

15. The method for showing an array microphone effect as claimed in claim 14, wherein the plurality of graphic components is laid to overlap with each other.

16. The method for showing an array microphone effect as claimed in claim 1, wherein the plurality of graphic components differs from each other in color.

17. The method for showing an array microphone effect as claimed in claim 1, wherein the plurality of graphic components differs from each other in gray level.

18. The method for showing an array microphone effect as claimed in claim 1, wherein the plurality of graphic components differs from each other in shape.

19. The method for showing an array microphone effect as claimed in claim 1, wherein the plurality of graphic components differs from each other in size.

20. The method for showing an array microphone effect as claimed in claim 1, further comprising generating a symbol in the figure when surroundings of the array microphones are silent.

21. The method for showing an array microphone effect as claimed in claim 1, wherein the figure is a run chart showing variations of the original acoustic signal with respect to time.

22. The method for showing an array microphone effect as claimed in claim 2, further comprising generating a symbol in the figure when a volume of the crystal voice is saturated.

* * * * *